US005486386A

United States Patent [19]

Rovsek

[11] Patent Number: 5,486,386

[45] Date of Patent: Jan. 23, 1996

[54] COLLAPSIBLE ARTIFICIAL CHRISTMAS TREE WITH OPEN MESH

[76] Inventor: Edward J. Rovsek, 2476 Brooklyn Rd., Jackson, Mich. 49203

[21] Appl. No.: 248,119

[22] Filed: May 24, 1994

[51] Int. Cl.[6] ..... A47G 33/06

[52] U.S. Cl. ..... 428/18; 428/20; 428/255

[58] Field of Search ..... 428/18–20, 10, 428/255

[56] References Cited

U.S. PATENT DOCUMENTS

| | | | |
|---|---|---|---|
| 3,096,943 | 7/1963 | Forrer | 428/19 X |
| 3,210,232 | 10/1965 | Wielland | 428/19 X |
| 3,677,867 | 7/1972 | Westlund | 428/20 X |
| 4,331,720 | 5/1982 | Vin Dick et al. | 428/20 X |
| 4,968,541 | 11/1990 | McCrory | 428/20 X |
| 5,085,901 | 2/1992 | Johnson et al. | 428/20 X |
| 5,128,180 | 7/1992 | Acton | 428/20 X |
| 5,338,585 | 8/1994 | Fraus et al. | 428/18 |

*Primary Examiner*—Henry F. Epstein
*Attorney, Agent, or Firm*—Dykema Gossett

[57] ABSTRACT

A collapsible artificial tree adapted to be supported at a top portion has compliant open mesh material approximately forming a conical shape. A plurality of axially spaced outer hoops defines the substantially conical shape of the tree with smaller inner hoops axially located between the outer hoops providing the artificial tree with the characteristic sawtooth profile of a coniferous tree. The mesh material may be in the form of netting, slit or perforated sheet material, or other readily compliant material.

14 Claims, 4 Drawing Sheets

COLLAPSIBLE ARTIFICIAL CHRISTMAS TREE WITH OPEN MESH

TECHNICAL FIELD

This invention relates to artificial trees and more particularly to artificial Christmas trees maintained in a display position by hanging it or otherwise supporting it at a top portion, and having a stored position in which the tree collapses into substantially a single plane.

BACKGROUND OF THE INVENTION

Known collapsible artificial Christmas trees typically employ suspension strings or cables or netting extending from a top of the tree to a hoop at a bottom portion of the tree, thereby defining a conical shape. Reinforcing hoops, graduated in size, are axially spaced between the top portion and the bottom portion. U.S. Pat. No. 5,085,901 to Johnson, et al. on Feb. 4, 1992, and U.S. Pat. No. 4,968,541 to McCrory issued on Nov. 6, 1990 and U.S. Pat. No. 3,677,867 to L. K. Westlund on Jul. 18, 1972 all illustrate this type of construction. U.S. Pat. No. 4,331,720 to Vin Dick, et al. on May 25, 1982 shows a collapsible artificial tree formed essentially of a generally spiral coil of steel wire stretched between two ends.

All of the above artificial trees provide a nearly perfect conical shape in an attempt to simulate coniferous trees. Such near perfect cones are readily distinguishable from genuine coniferous trees which have more of a notched or sawtooth type profile due to axial distances between the limbs.

It is desirable to provide an artificial Christmas tree having a sawtooth profile.

The present invention is directed to overcoming one or more of the problems as set forth above.

SUMMARY OF THE INVENTION

In one aspect of the present invention an artificial coniferous tree adapted for suspension from a supporting structure is disclosed comprising a piece of highly compliant open mesh material approximately forming a conical shape and having a top portion from which the decoration is adapted to be suspended. A plurality of outer hoops is fixed to the mesh. The hoops define an outer radial periphery of the mesh and are disposed approximately concentrically along an axis. The hoops are graduated from a small diameter hoop located proximate to the top portion to a large diameter hoop located distal to the top portion. A plurality of inner hoops has at least one axially located between a pair of diametrically larger axially adjacent hoops of the first plurality of hoops and is fixed to the mesh thereat to provide an accurate representation of a coniferous tree.

DESCRIPTION OF THE PREFERRED EMBODIMENT

Figure 2:
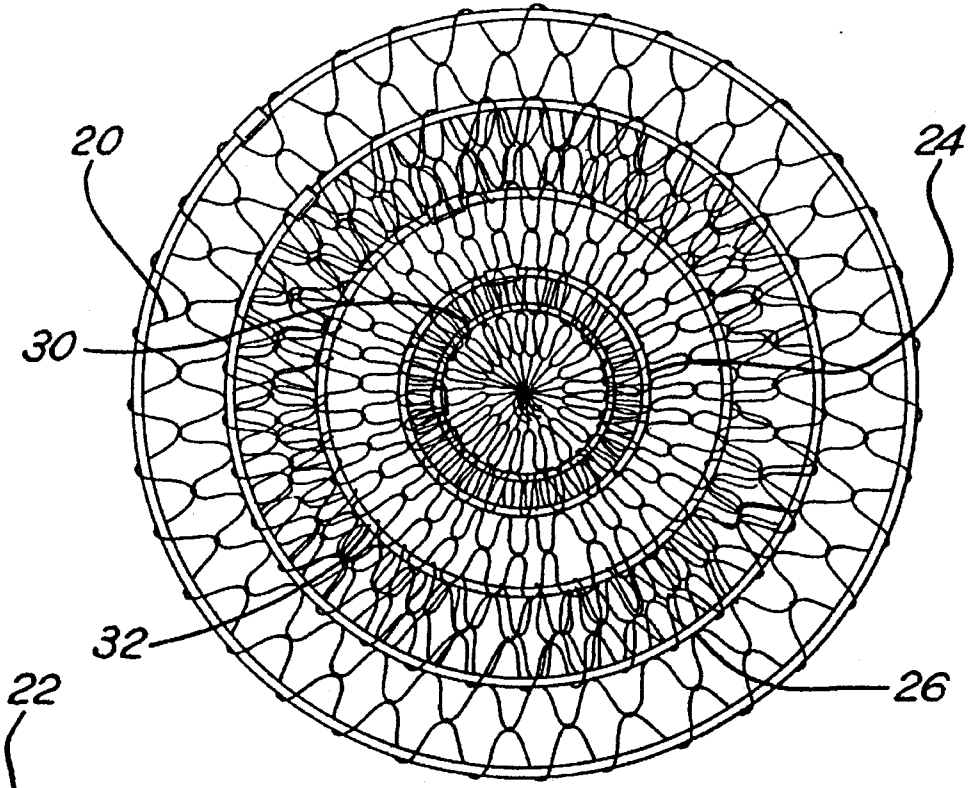
FIG. 2 is a top view of the artificial tree of the present invention in a storage position.
Figure 1:
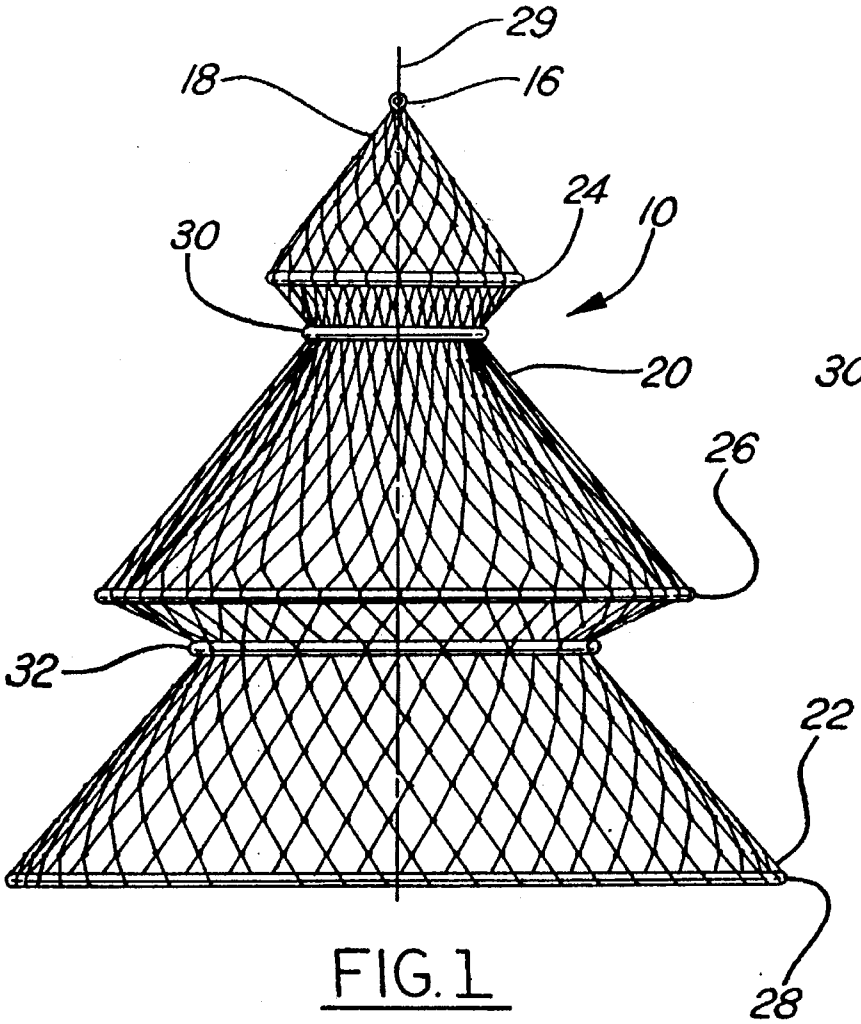
FIG. 1 is a side view of an artificial tree of the present invention in a display position.

An artificial Christmas tree 10 is shown in FIG. 1 is suspended by a chain 12 from a ceiling 14 of a room. The chain 12 engages the tree 10 through an attachment member 16 such as a cloth loop extending from a top portion 18 of the tree. Netting 20 provides an open mesh which extends from the top portion 18 to a bottom portion 22 of the tree 10. The netting 20 has an approximately conical shape.

A plurality of steel outer hoops, three in the present invention, are graduated from a small diameter outer hoop 24, to a medium diameter outer hoop 26, and finally to a large diameter outer hoop 28. The outer hoops 24–28 are fixed to the netting 20 so as to at least partially define an outer radial periphery of the netting 20. The hoops 24–28 are disposed approximately concentrically along an axis 29 and approximately evenly spaced therealong with the small diameter outer hoop 24 located proximate to the top portion 18 and the large diameter hoop located at the bottom portion 22 distal to the top portion 18 and the medium diameter outer hoop 26 located therebetween.

Figure 4:
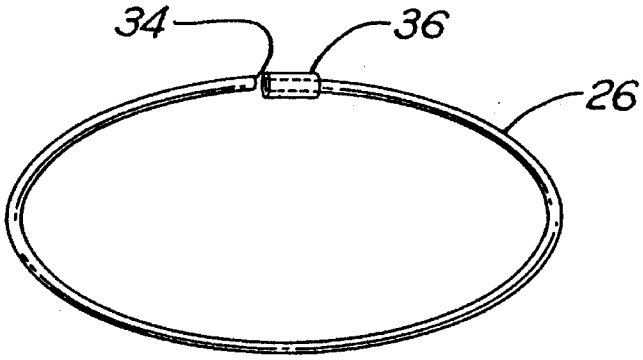
FIG. 4 is a perspective view of a hoop of the present invention.
Figure 3:
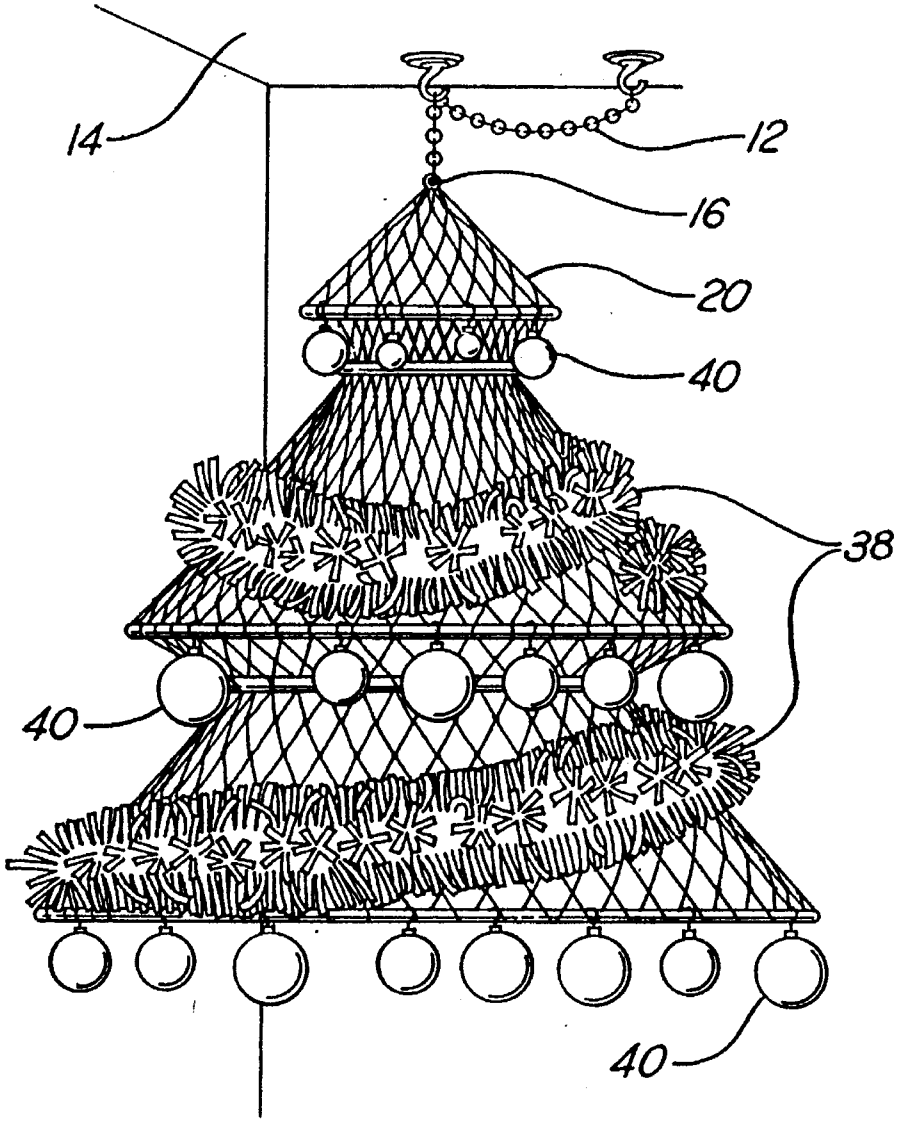
FIG. 3 is a side view of an artificial tree in the display position with a full complement of decorations.
Figure 6:
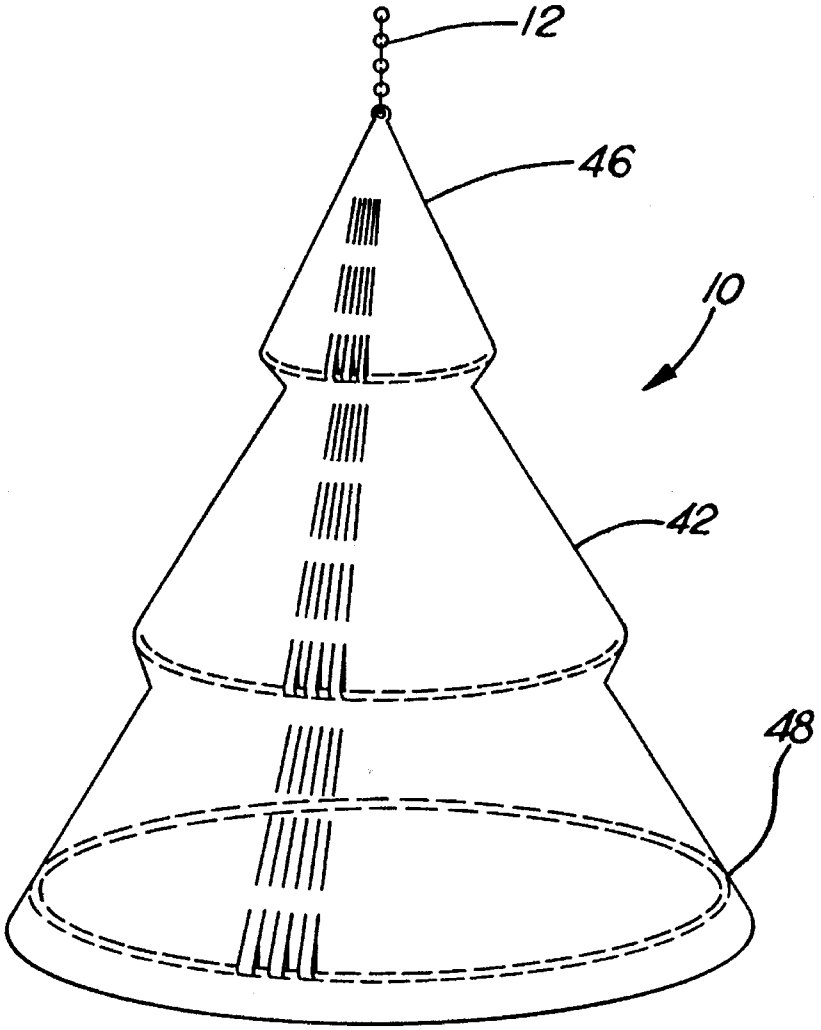
FIG. 6 is a perspective view of an artificial tree employing the alternative open mesh.

A plurality of steel inner hoops, two in the present embodiment, include a small diameter inner hoop 30 and a medium diameter inner hoop 32. The small inner diameter hoop 30 is of a smaller diameter than both the small diameter outer hoop 24 and the medium diameter outer hoop 26. Each of the inner hoops 30, 32 and outer hoops 24–28 has a split 34 as shown in FIG. 4, with a tube 36 being used to selectively close the split 34.

The small diameter outer hoop 24 is fixed to the netting 20 closest to the top portion 18 of any of the hoops. With the netting 20 suspended from its attachment member 16 by the chain 12, the small diameter outer hoop 24 together with the netting 20 defines a conical shape. The conical shape extends downward from the small diameter outer hoop 24 with the medium and large outer diameter hoops 26, 28 fixed to the netting.

The outer hoops 24–28 are disposed approximately concentrically along the axis 23 and are approximately evenly spaced along the axis. Each outer hoop 24–28 is sufficiently heavy to force the netting to comply with the shape of the hoop and to draw the netting tight in a vertical direction.

The inner hoops 30 and 32 are placed between the small and medium and between the medium and large hoops respectively. The inner hoops 30, 32 are placed closer to the small outer hoop 24 and the medium outer hoop than to the medium outer hoop diameter 26 and larger diameter outer hoop respectively to provide the desired simulation of a profile of a coniferous tree. This provides the desired sawtooth profile instead of merely a zig-zag profile. The hoops 24–32 are fixed to the netting in the following manner. The tube 36 is worked back along the hoop to open the split 34. Strands of the net 20 are passed through the split 34, effectively weaving the hoops 24–32 in and out of the netting 20 to produce the desired engagement therebetween. When each of the hoops are fully woven into the netting 20, the tubes 36 are worked back over the split 34 in each of the hoops 24–32. This prevents the hoops 24–32 from inadvertently working themselves free from the netting 20.

One alternative to weaving hoops into the netting 20 would be to sew hoops onto the netting 20 in the desired locations. Certain types of adhesives might also be suitable for fixing the hoops to the netting 20 in desired locations.

Once all five of the hoops 24–32 have been installed in the netting 20, the suspended artificial tree 10 has the desired sawtooth profile in a display position as illustrated in FIG. 1. In this position, the hoops 24–32 are held in the axial position by the netting 20, and the netting 20 is radially shaped by the rings 24–32. Unhooking the attachment member 16 from the chain 12 and lowering the tree 10 onto a flat surface such as the floor or storage box allows the tree 10 to collapse to a storage position in a single plane with all of the hoops 24–32 lying in a substantially concentric co-planar arrangement. To return the tree 10 to its tree-like shape, it need merely be hung by its attachment member 16 from the chain 12 again.

The open mesh of the netting 20 is ideally suited for supporting various decorations and ornaments. Garland 38 can be interwoven through the netting 20 for a decorative effect. Weaving in sufficient garland to cover much of the area of the tree 10 provided by the netting 20 would heighten the resemblence of the artificial tree 10 to a natural Christmas tree. Other decorations, such as lights or hanging bulbs 40 can be hung from and draped around the tree. It is recognized, of courser that decorations for the artificial tree 10 need not be limited to those pertaining to Christmas. Generic decorations, or decorations appropriate to other holidays may also be hung from such a structure. Even with such decorations in the netting 20, the artificial tree 10 can still be collapsed nearly fiat to the storage position. The principal concern with collapsing a decorated tree would be the susceptibility of any decorations on the tree to breakage from crushing.

Figure 5:
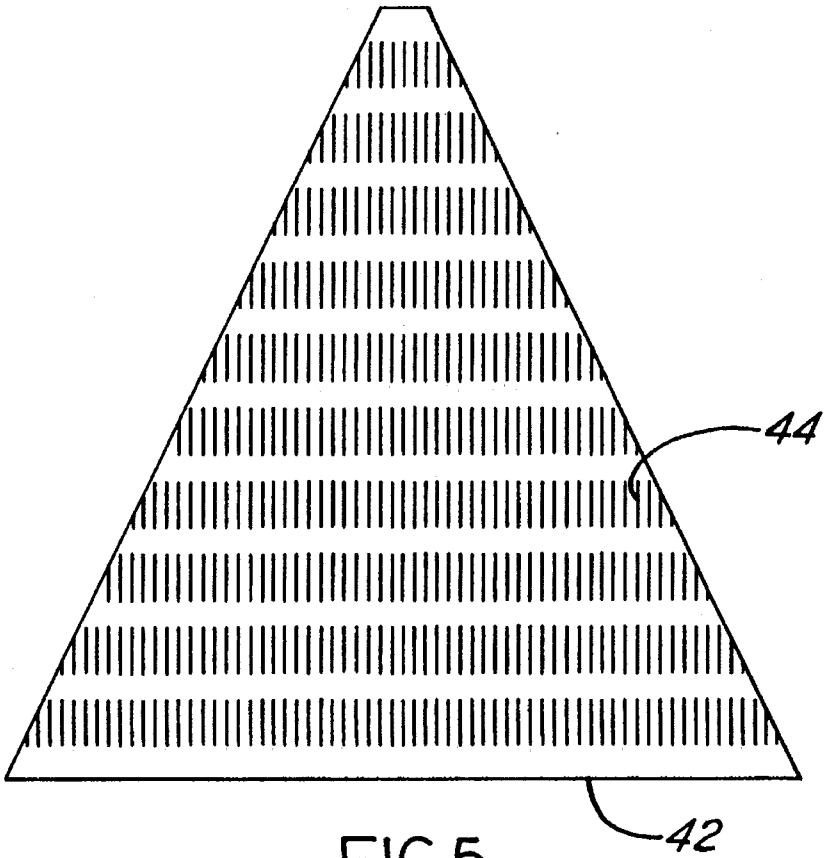
FIG. 5 is a plan view of an alternative form of open mesh for the present invention.
Figure 8:
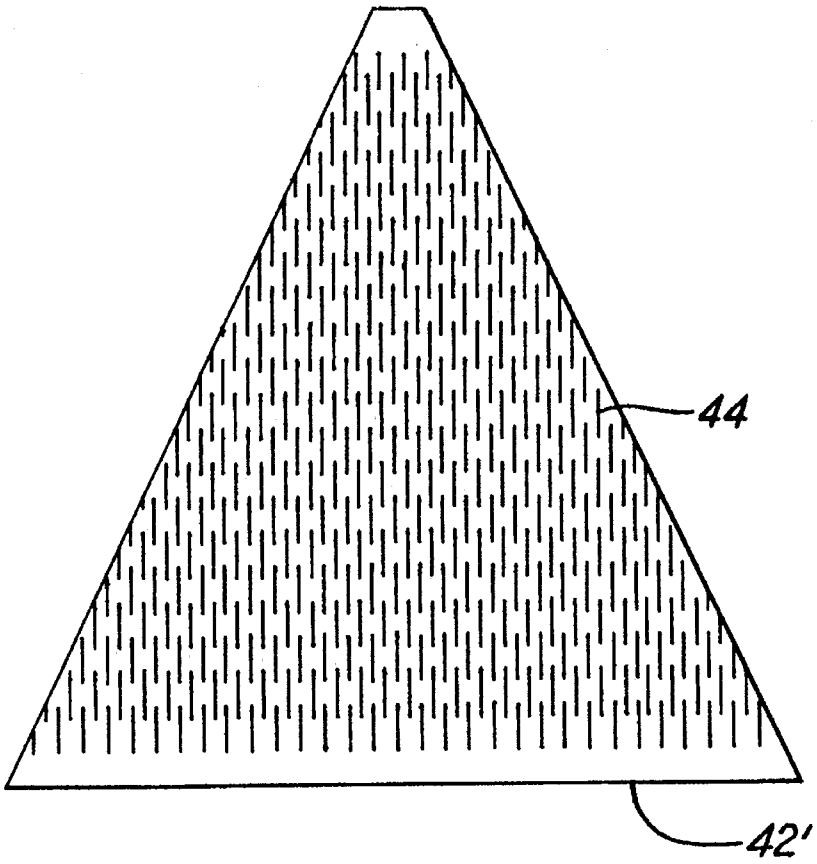
FIG. 8 is a plan view of a second alternative form of open mesh for the present invention.

A form of open mesh alternative to the netting is found in plastic sheeting formed into a bag type device 42 of a generally conical shape with a plurality of perforations in the form of holes or slits 44. The exemplary vertical slits shown in FIG. 5 are in evenly spaced rows. The exemplary slits 44 are approximately 1.5 inches long with approximately 0.75 inches between rows. Hoops, such as the one 48 installed at a bottom portion, are interwoven through the slits 44. This plastic could be transparent or could alternatively be colored. In yet another alternative form, the plastic bag 42 could have two colors, such as red on an outside and green on an inside. This can be accomplished using two-ply construction for the bag. An alternative configuration of the bag 42' illustrated in FIG. 8 has the vertical slits 44 staggered instead of in single rows. This allows the bag expand radially. In yet another alternative configuration (not shown) the bag has the slits oriented offset as in FIG. 8, but oriented horizontally instead of vertically.

Yet another substitute for the netting is a bag of similar construction to that of the plastic bag 42, but instead formed of cloth or paper. Additionally, hoops could be formed of materials besides steel, such as plastic, cardboard or wood. As a further alternative, the hoops could have a non-circular shape, to provide enhanced realism to the exterior contour of the artificial tree. The inner hoops need not be made of rigid material. The hoops need only be strong enough to gather material beneath a superior outer ring to provide the desired sawtooth profile. Ribbon, string, twine, and thread are all possible alternative options to rigid hoops.

It is also to be readily appreciated that the size of the artificial Christmas tree 10 can be varied widely. Although the figures show the artificial Christmas tree 10 as being quite substantial in height, alternative versions may be designed of a size suitable for hanging over dining room tables or the like. The trees 10, of whatever size, may alternatively be supported by a post or similar upright vertical support disposed on an inside of the tree instead of being hung from a chain, allowing the tree to stand on a floor or table. Conceivably, a tree could even be configured to pop up from a greeting card.

Figure 7:
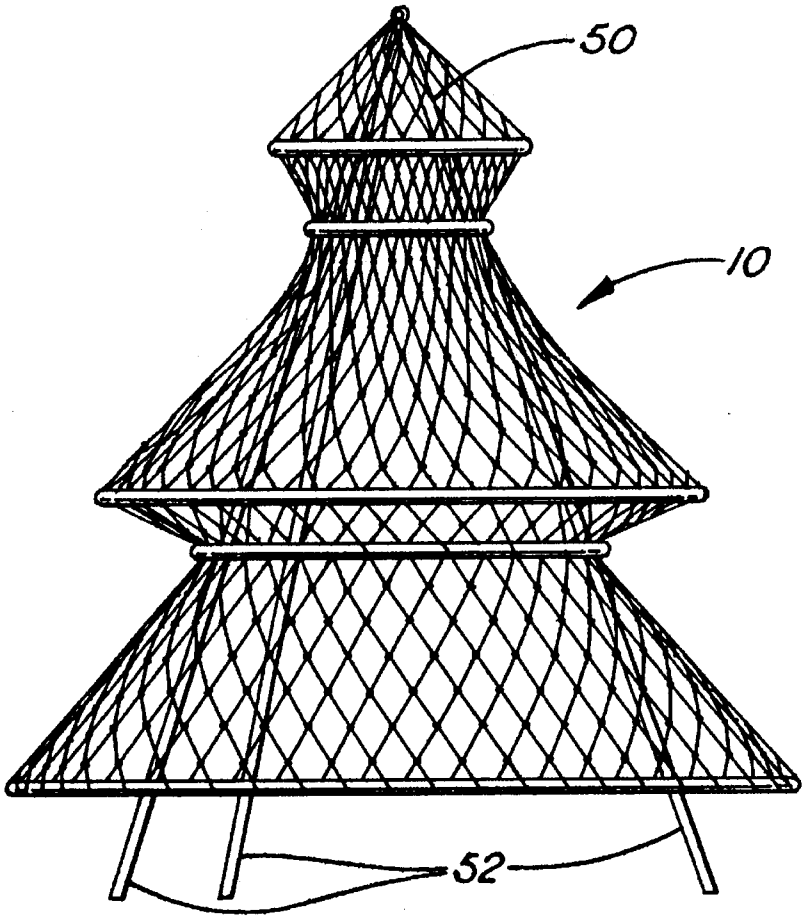
FIG. 7 is a side view of an artificial tree supported by a tripod.

One alternative upright vertical support 50 is a tripod arrangement of three dowels 52 as illustrated in FIG. 7. The dowels are held together at a top point over which the tree 10 is disposed. The amount which the tripod is able to open is limited by one of the inner hoops 30, 32.

Trees formed with bags 42 having different inside and outside colors can be reversed to selectively expose the desired color. Reversal is accomplished by removal of the inner diameter hoops 30, 32, turning the bag 42 inside out to (with the outer hoops still attached) reverse the color, and replacing the inner diameter hoops 30, 32.

Other aspects, objects, and advantages of this invention can be obtained from a study of the drawings, the disclosure, and the appended claims.

I claim:

1. An artificial coniferous tree adapted for suspension from a supporting structure, comprising:

an engagement means selectively enraged with the supporting structure for suspending the tree in a display position;

compliant open mesh material approximately forming a conical shape and having a top portion extending from the engagement means;

a plurality of outer hoops fixed to the mesh thereby at least partially defining an outer radial periphery of the mesh, the hoops being disposed approximately concentrically along a substantially vertical axis of the tree in the display position and being graduated from a small diameter hoop located proximate to the engagement means to a large diameter hoop located distal to the engagement means wherein in the display position the weight of the suspended outer hoops tensions the mesh to define the conical shape; and at least one inner hoop axially located between two diametrically larger axially adjacent outer hoops and fixed to the mesh thereat, wherein when the tree is in the display position the mesh is tensioned by the weight of the rings thereby providing a sawtooth profile representative of a coniferous tree, and further wherein when the engagement means is released from the supporting structure and lowered to a flat surface the tree rings and the mesh collapse into a substantially flat storage position.

2. An artificial tree as claimed in claim 1, wherein the hoops are split in at least one place.

3. An artificial tree as claimed in claim 2, wherein the hoops are fixed to the mesh by passing the split hoops in and out of the open mesh at predetermined axial locations.

4. An artificial tree as claimed in claim 3, wherein the hoops have closures closing the splits to retain the hoops in the mesh.

5. An artificial tree as claimed in claim 1, wherein the mesh is in the form of sheet material having a plurality of perforations.

6. An artificial tree as claimed in claim 5, wherein the perforations are in the form of parallel slits.

7. An artificial tree as claimed in claim 6, wherein the sheet material is of a first color on an outside and is of a second color on an inside and is reversible between the inside and the outside.

8. An artificial tree as claimed in claim 1, additionally comprising at least one garland woven into the open mesh material thereby more closely simulating a coniferous tree.

9. An artificial tree as claimed in claim 1, wherein there are a plurality of inner hoops fixed to the mesh in axially alternate locations with respect to the outer hoops.

10. An artificial tree as claimed in claim 9, wherein the inner hoops are flexible cords which gather the open mesh material.

11. An artificial tree as claimed in claim 10, wherein the flexible cords are woven in and out of the open mesh material.

12. An artificial tree as claimed in claim 1, wherein the outer radial periphery of the mesh at the hoops conforms to the shape of the hoops.

13. An artificial tree as claimed in claim 1, wherein the at least one inner hoop is a flexible cord which gathers the open mesh material.

14. An artificial tree as claimed in claim 13, wherein the flexible cord is woven in and out of the open mesh material.

* * * * *

UNITED STATES PATENT AND TRADEMARK OFFICE

CERTIFICATE OF CORRECTION

PATENT NO. : 5,486,386

DATED : January 23, 1996

INVENTOR(S) : Edward J. Rovsek

It is certified that error appears in the above-identified patent and that said Letters Patent is hereby corrected as shown below:

Column 4, line 27, delete "enraged" and substitute therefor --engaged--.

Signed and Sealed this

Twenty-sixth Day of March, 1996

*Attest:*

Bruce Lehman

BRUCE LEHMAN

*Attesting Officer*

*Commissioner of Patents and Trademarks*